US005152517A

United States Patent [19]

Ruch et al.

[11] Patent Number: 5,152,517

[45] Date of Patent: * Oct. 6, 1992

[54] APPARATUS FOR CONTROLLING THE MOVEMENT OF TRAYS OF PAPER WITHIN AN ELECTROPHOTOGRAPHIC PRINTER

[75] Inventors: Mark H. Ruch; Roger Q. Paulsel; James M. Bradshaw, all of Houston, Tex.

[73] Assignee: Compaq Computer Corporation, Houston, Tex.

[ * ] Notice: The portion of the term of this patent subsequent to Apr. 9, 2008 has been disclaimed.

[21] Appl. No.: 643,859

[22] Filed: Jan. 18, 1991

Related U.S. Application Data

[63] Continuation of Ser. No. 360,437, Jun. 2, 1989, Pat. No. 5,044,620.

[51] Int. Cl.[5] ..... B65H 3/44

[52] U.S. Cl. ..... 271/9; 271/162; 271/164; 414/416; 414/331

[58] Field of Search ..... 271/9, 162, 164, 158, 271/117, 118; 414/331, 416

[56] References Cited

U.S. PATENT DOCUMENTS

| | | | |
|---|---|---|---|
| 4,660,820 | 4/1987 | Shino et al. | 271/9 X |
| 4,745,266 | 5/1988 | Miura | 271/9 X |
| 4,770,403 | 9/1988 | Katsumata et al. | 271/9 X |
| 4,775,138 | 10/1988 | Müller | 271/164 X |
| 4,934,686 | 6/1990 | Ono et al. | 271/117 |

FOREIGN PATENT DOCUMENTS

| | | | |
|---|---|---|---|
| 3219784 | 12/1982 | Fed. Rep. of Germany | 271/9 |
| 40348 | 3/1985 | Japan | 271/9 |

*Primary Examiner*—Donald T. Hajec
*Assistant Examiner*—Kenneth DeRosa
*Attorney, Agent, or Firm*—Irene Kosturakis; James R. Burdett; J. David Cabello

[57] ABSTRACT

A paper handling apparatus 10 includes a plurality of paper receiving trays 12, 14, 16, 18 arranged vertically in close proximity to one another with a single paper feeding mechanism 20 provided to operate with all of the trays 12, 14, 16, 18. The paper feeding mechanism 20 moves vertically to selectively engage any selected one of the plurality of trays 12, 14, 16, 18. The vertical arrangement of the trays 12, 14, 16, 18 dictates that the trays are horizontally moveable between a first unselected position, where the trays are substantially vertically aligned with the one another, and a second selected position where the tray is horizontally moved to intersect the vertical path of the paper feeding mechanism 20. Horizontal movement of the trays 12, 14 16, 18 is effected by a single electric motor 28 rotatably attached to a shaft 30, which carries a series of gears 32, 34, 36, 38 that interact with a corresponding rack 40, 42, 44, 46 disposed on each of the trays 12, 14, 16, 18, respectively. A transmission 48 links the motor 28 to the gears 32, 34, 36, 38 to selectively drive one of the gears and move one of the trays between the selected and unselected positions.

4 Claims, 4 Drawing Sheets

APPARATUS FOR CONTROLLING THE MOVEMENT OF TRAYS OF PAPER WITHIN AN ELECTROPHOTOGRAPHIC PRINTER

This application is a continuation of application Ser. No. 07/360,437 filed Jun. 2, 1989, now U.S. Pat. No. 5,044,620.

BACKGROUND OF THE INVENTION

1. Field of the Invention

This invention relates generally to printers and, more particularly, to an apparatus for controlling the movement of selected paper-holding trays of an electrophotographic printer.

2. Description of the related art

Printers, such as electrophotographic and laser printers, are typically used in an office environment where they are connected to personal computers, personal computer networks or dedicated word processing computers. Most laser printers used in offices share common advantageous characteristics: small size, high quality print, quiet operation, and good speed for most applications.

Laser printers include paper handling mechanisms that usually employ separate trays for holding different types or different sizes of paper. These trays are typically configured to hold approximately 250 sheets of paper. If the paper handling mechanism of a laser printer includes only one tray, then the laser printer is capable of withdrawing paper from only the one tray during a requested printing operation. When the printer receives instructions to print on different types of paper during a print request, the single tray must be removed and replaced with a tray containing the proper paper.

To solve this problem, laser printers have been adapted to include multiple trays from which different types or different sizes of paper may be withdrawn. When a multiple-tray printer receives instructions to print on different type of paper during a print request, the paper handling mechanism associated with the printer simply withdraws paper from the appropriate tray.

A paper feeding mechanism is used to withdraw paper from a tray, and typically includes at least one rubber-like roller that rotatably engages the paper within the tray and draws the paper into the printing mechanism. When a laser printer includes a paper handling mechanism that includes more than one tray, each tray ordinarily has a dedicated paper feeding mechanism associated therewith. Further, the trays and their associated paper feeding mechanisms ar normally stacked in a vertical arrangement, and, therefore, consume vertical space equal to the vertical height of each 250 sheet tray and the vertical height of each paper feeding mechanism. Accordingly, the combined vertical height of each tray and paper feeding mechanism limits the maximum number of trays that can be associated with a paper handling mechanism of a laser printer.

Since the commonly used paper trays include a spring which forces the paper within the tray into contact with the rubber-like roller of its associated paper feeding mechanism, the pressure between the paper picker and the stack of paper varies with the thickness of the stack of paper remaining in the tray. The paper feeding mechanism is stationary, so that the spring force applied to the stack of paper constantly maintains the top sheet of paper in contact with the paper feeding mechanism.

Thus, when it is desired that additional paper should be loaded into a particular tray, the printing process from that tray must cease while the tray is removed and the paper supply replenished. This is particularly important where the user wishes to print a short run of unique paper that differs from the paper currently loaded in the tray.

Previous laser printers have employed a single sheet feeding mechanism whereby an operator desiring to print a small number of copies on a paper style unique from that currently loaded in the trays may singularly and consecutively feed the number of sheets required for the printing process. This, of course, is a time intensive process that does not free the user to accomplish other tasks, but requires that the user remain at the printing station, consecutively feeding each sheet of paper into the printer, until the entire printing process is complete.

Alternatively, the user may remove the tray from the paper handling mechanism, insert the desired number of pieces of paper into the tray and replace the tray in the paper handling cassette. While this method does free the user to leave the area of the printer during the printing process, the procedure of removing the tray and loading the tray with a precise preselected number of unique sheets of paper causes the printer to discontinue printing until the tray has been replaced.

The present invention is directed to overcoming one or more of the problems as set forth above.

SUMMARY OF THE INVENTION

The primary object of the present invention is to provide a paper handling mechanism, particularly for use with an electrophotographic printer, that is compact in size and which delivers a large capacity and variety of paper.

Another important object of the present invention is to provide an electrophotographic printer in accordance with the primary objective that includes a greater number of paper trays and which occupies approximately the same space as conventional electrophotographic printers.

Yet another object of the present invention is to provide a paper handling mechanism for an electrophotographic printer that is readily loaded with limited supplies of unique paper so as to allow the electrophotographic printer to access unique paper styles for short runs.

Yet another object of the present invention is to provide a paper handling mechanism in accordance with the primary objective that automatically selects the tray containing paper requested during a printing operation.

Still another object of the present invention is to provide a paper handling mechanism that is simple in construction and operation.

A further object of the present invention to provide an apparatus, associated with the paper handling mechanism of the present invention, that controls the movement of a plurality of trays.

Still another object of the present invention is to provide a paper handling mechanism that includes a series of vertically stacked trays, which are manually and automatically horizontally movable to a readily accessible loading position.

In accordance with one aspect of the present invention, a paper handling apparatus for an electrophotographic printer is provided. The apparatus includes paper feeding means for contacting a selected one of a plurality of stacks of sheets of paper and removing a selected one of the sheets of paper from the selected stack of sheets of paper. The paper feeding means is controllably moveable along a preselected substantially vertical path. Each of a plurality of paper receiving trays are adapted for receiving a stack of sheets of paper, where the plurality of trays are generally vertically arranged relative to one another and are adapted for general horizontal movement between a first selected position and a second unselected position. The first selected position intersects the substantially vertical path of the paper feeding means. The apparatus further includes a motor and transmission means for selectively engaging the motor with one of the plurality of trays and moving the selected tray between the first selected position and the second unselected position.

BRIEF DESCRIPTION OF THE DRAWINGS

Other objects and advantages of the drawings will become apparent upon reading the following detailed description and upon reference to the drawings in which.

Figure 1:
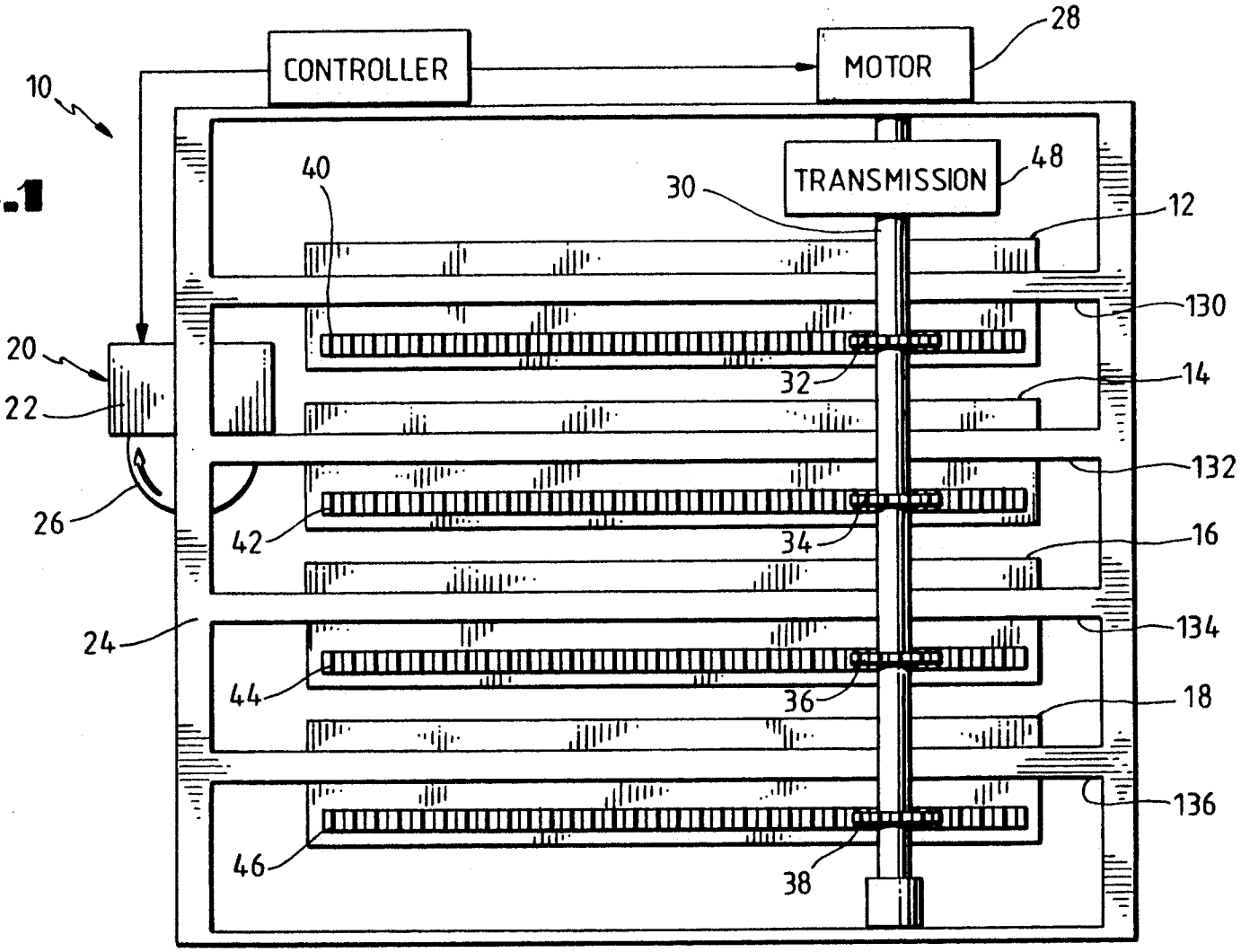
FIG. 1 generally illustrates a paper handling mechanism in accordance with the present invention.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENT

Turning to the drawings and referring first to FIG. 1, a side view of a conceptual schematic of a paper handling apparatus 10 for a printer (not shown) is shown. While the discussion of the apparatus 10 herein is confined to being combined with an electrophotographic printer, it is readily envisioned that the apparatus 10 may be combined with various types and styles of printers without departing from the spirit and scope of the instant invention.

The apparatus 10 includes a plurality of paper containing trays 12, 14, 16, 18, which are configured to receive a variety of different styles and sizes of sheets of paper 19. Preferably, each tray 12, 14, 16, 18 contains a different style of paper so that a user of the electrophotographic printer simply designates which tray to use in order to select the proper style of paper. For example, it is desirable to load each of the trays 12, 14, 16, 18 respectively with letterhead, white bond, yellow bond, A4, legal, etc. Thus, the user is relieved of the time consuming task of loading the printer with additional paper each time a different style of paper is desired.

In order to conserve space and reduce the overall cost of the paper handling apparatus 10, the trays 12, 14, 16, 18 are arranged vertically in close proximity to one another with a single paper feeding mechanism 20 provided to operate with all of the trays 12, 14, 16, 18. The paper feeding mechanism 20 moves vertically to selectively engage each of the plurality of trays 12, 14, 16, 18. This vertical movement is effected by an electric motor 22 that is connected to and possibly travels with the paper feeding mechanism 20 along a vertical frame assembly 24.

The vertical frame assembly 24 is constructed from any of a variety of devices, including a rack and pinion and a rolamite. One embodiment of such a vertical frame assembly 24 and paper feeding mechanism 20 is discussed in U.S. Pat. No. 5,005,817 to Ruch et al.

It should be noted that the motor 22 also provides power to a rotating rubber wheel 26 that contacts the stacks of paper located in each of the trays. Contact between the rotating wheel 26 and the top sheet in any of the stacks of paper urges the top sheet from the stack and into the electrophotographic printer, where the actual printing process is performed.

The paper feeding mechanism 20 is generally limited to vertical movement, while the trays 12, 14, 16, 18 are also vertically arranged. Therefore, in order for the paper feeding mechanism 20 to contact a selected one of the stacks of paper, the trays 12, 14, 16, 18 are preferably horizontally moveable between a first unselected position and a second selected paper-feeding position where the tray intersects the vertical path of the paper feeding mechanism 20.

A single electric motor 28 provides the mechanical power to selectively drive the trays 12, 14, 16, 18 between these first and second positions. The motor 28 is connected to a shaft 30, which extends vertically along one side of the trays 12, 14, 16, 18. A plurality of gears 32, 34, 36, 38 are fixed to the shaft 30 at various vertical locations so as to respectively coincide with racks 40, 42, 44, 46 extending horizontally along the side of each of the trays 12, 14, 16, 18. Thus, rotation of the motor 28 in a first direction produces similar rotation in the shaft 30 and the gears 32, 34, 36, 38.

The gears 32, 34, 36, 38 interact with their corresponding rack 40, 42, 44, 46 and convert the rotational movement into horizontal linear movement of each of the trays 12, 14, 16, 18. It should be clear that rotation of the motor 28 in a first direction produces horizontal movement of the trays 12, 14, 16, 18 from the first to the second position, while rotation of the motor 28 in a second direction moves the trays 12, 14, 16, 18 from the second to the first position.

However, it should be appreciated that in order for the paper feeding mechanism 20 to properly intersect with the trays 12, 14, 16, 18, the selected tray is preferably horizontally moved between the unselected and selected position without corresponding movement of the unselected trays. For example, if the user desires to print on paper contained in the lowest tray 18, then not only must tray 18 move to the selected position, but the unselected trays 12, 14, 16 must remain in the unselected position. Otherwise, the trays 12, 14, 16 interfere with vertical movement of the paper feeding mechanism 20 and prevent the paper feeding mechanism 20 from descending to and contacting with the paper contained in the lowest tray 18. It should be appreciated that similar problems arise when operation of any one of the other trays 12, 14, 16 is desired.

Accordingly, the motor 28 and shaft 30 employ a transmission 48 to selectively engage only one of the desired gears 32, 34, 36, 38.

Figure 2:
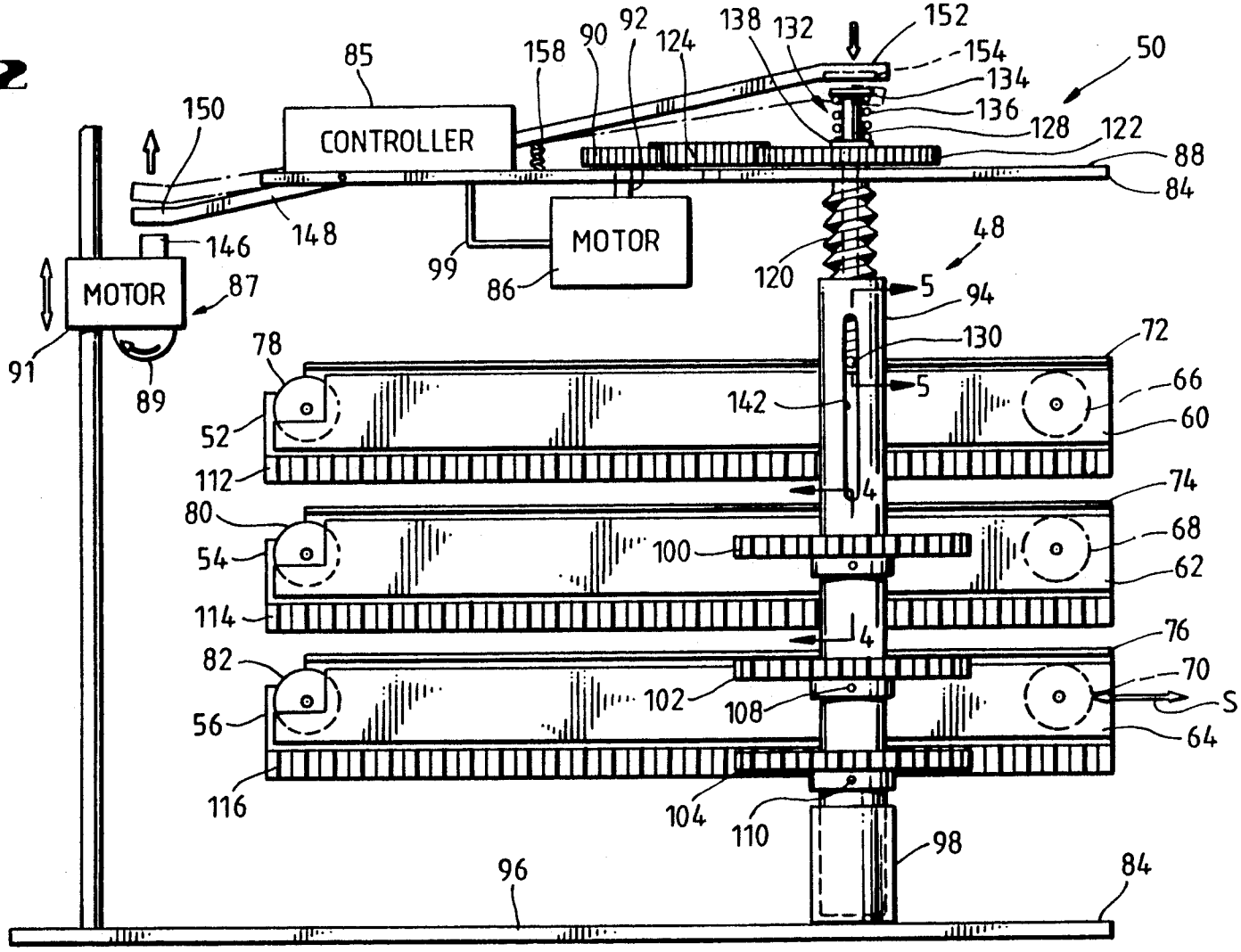
FIG. 2 is a detailed side plan view of an apparatus for controlling the movement of a plurality of trays in accordance with the present invention.

FIG. 2 illustrates an apparatus, generally designated by the reference numeral 50, that controls the movement of a plurality of trays 52, 54, 56. The apparatus 50 is conceptually quite similar to the apparatus 10 previously described, however, FIG. 2 illustrates a specific implementation of the transmission 48 in conjunction with a paper handling mechanism which includes three paper-holding trays 52, 54, 56. Note that the apparatus 50 does not include side portions of a frame for ease of illustration, but a frame similar to the frame 24 is preferably used to support various elements of the apparatus 50.

The trays 52, 54, 56 are sized to accommodate a selected size of paper, and, therefore, may be roughly 8.5 by 11 inches or 8.5 by 14 inches, for instance. However, for ease of illustration, the trays 52, 54, 56 are shown in FIG. 2 to be approximately equal to one another in size.

The trays 52, 54, 56 are adapted to slide in the horizontal direction as designated by a double-headed arrow 58. Therefore, each of the trays 52, 54, 56 is slidably mounted on respective rails 60, 62, 64. A roller 66, 68, 70 is rotatably mounted one end of each of the rails 60, 62, 64 so that each roller 66, 68, 70 engages with a corresponding upper, outwardly extending lip 72, 74, 76 provided on each of the respective trays 52, 54, 56. To support the end of each tray 52, 54, 56 that is opposite the rollers 66, 68, 70, rollers 78, 80, 82 are rotatably mounted on one end of each tray 52,54,56 so that the rollers 78, 80, 82 ride on a lower flange portion of the rails 60, 62, 64.

Figure 4:
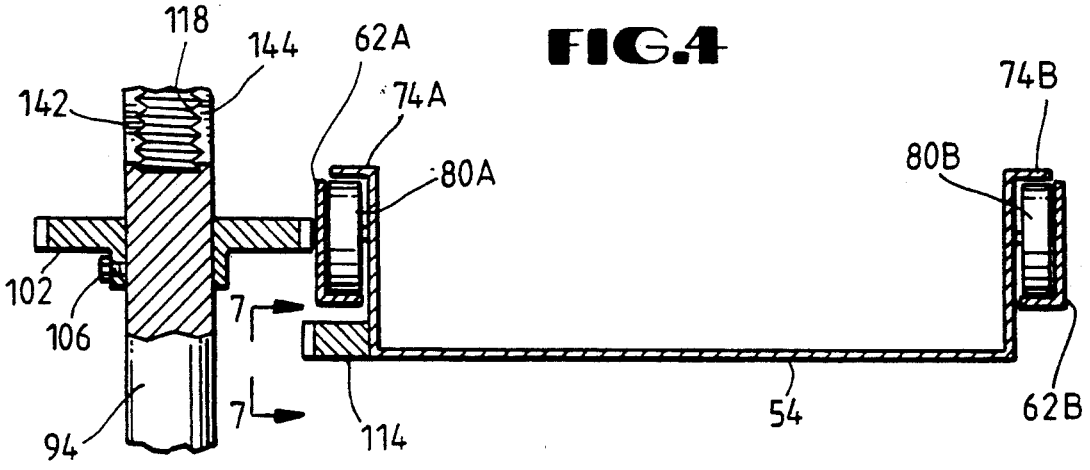
FIG. 4 is a cross-sectional view of a paper tray and its corresponding drive mechanism taken along line 4—4 in FIG. 2.

Preferably, each tray is supported on two sides. Therefore, as illustrated in the cross-section of tray 54 in FIG. 4, each tray includes two opposing lips 74A, 74B and two opposing rollers 80A, 80B, so that each tray is supported by two rails 62A, 62B. It should be noted that the rails 60, 62, 64 on each side of the trays 52, 54, 56 are preferably mounted, i.e., by brackets, directly to side portions (not shown) of a frame 84.

An electronic control 85 controls the vertical movement of a paper feeding mechanism 87, which includes a rotatable, paper-contacting wheel 89 driven by a motor 91. The electronic control 85 also controls the transmission 48. A motor 86, which is mounted on an upper portion 88 of the frame 84, powers the transmission 48 and includes a gear 90 that is mounted to an output shaft 92.

The transmission 48 includes a tubular shaft 94 that is mounted between the upper portion 88 of the frame 84 and a lower portion 96 of the frame 84. The lower portion of the tubular shaft 94 resides within a coupling 98 that is mounted on the lower portion 96 of the frame 84. The coupling 98 allows the shaft 94 to slide axially and to rotate about its axis.

Three gears 100, 102, 104 are mounted to the shaft 94 in spaced apart relation, and secured thereto by means of respective set screws 106, 108, 110, for instance. The gears 100, 102, 104 are adapted to mesh with associated racks 112, 114, 116 that are mounted to one side of the respective trays 52, 54, 56. A selected gear 100, 102, 104 engages its respective rack 112, 114, 116 to move a selected tray 52, 54, 56 between the first and second positions, as previously described.

Figure 7:
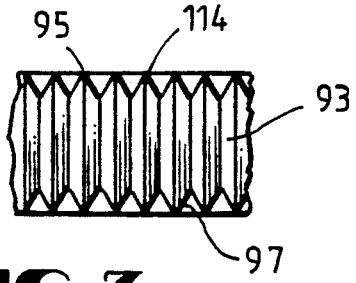
FIG. 7 is an end on view of gear teeth taken along line 7—7 in FIG. 4.
Figure 8:
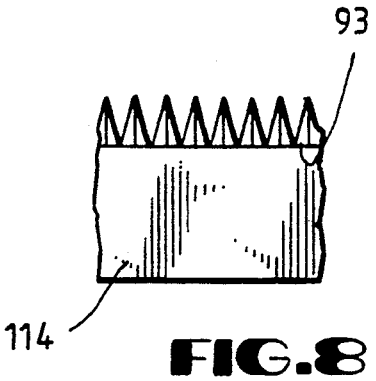
FIG. 8 is a side view of gear teeth taken along line 8—8 in FIG. 7.

Preferably, the teeth of the gears 100, 102, 104 and of the racks 112, 114, 116 are self-aligning so that each gear always meshes with its associated rack. As shown in FIGS. 7 and 8 with respect to the rack 114 (although it is to be understood that each rack and each gear carry similar teeth), the teeth 93 include upper and lower tapering portions 95, 97 that allow the teeth of the vertically moving gears to slide in between the teeth of the stationary racks.

The shaft 94 positions one of the gears 100, 102, 104 in engagement with its associated rack 112, 114, 116 before the selected tray 52, 54, 56 is moved between the first and second positions. Therefore, the shaft 94 moves axially to three different preselected locations to mesh one of the three gears 100, 102, 104 with its associated rack 112, 114, 116.

The vertical spacing between the gears 100, 102, 104 is such that, in any of the three preselected locations, only one gear engages with a rack at any given time. As shown in FIG. 2, the gear 104 is in a preselected location and engaged with the rack 116 on the tray 56.

To axially move the gears, the shaft 94 includes an inner threaded portion 118 (see FIG. 4) that matingly engages with one end of a screw 120. The other end of the screw 120 is rotatably mounted to a gear 122 on the upper portion 88 of the frame 84. The gear 90 on the output shaft 92 of the motor 86 drives an idler gear 124 that drives the gear 122 in the same direction as the gear 90. If the shaft 94 is fixed so that it cannot rotate, rotation of the screw 120 in a first direction drives the shaft 94 upwardly, and rotation of the screw 120 in a second direction drives the shaft 94 downwardly.

While it is obviously desirable for the shaft 94 to remain rotatably fixed during the positioning of the gears, the shaft 94 is adapted to rotate when the selected gear is in position in order to drive the selected tray horizontally. Therefore, a means is provided for preventing rotation of the shaft 94 during the gear positioning operation, and for allowing rotation of the shaft 94 during the tray moving operation.

Figure 5:
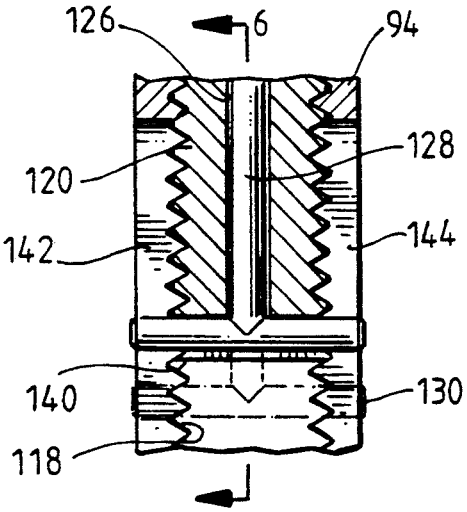
FIG. 5 is a cross-sectional view of the drive mechanism taken along line 5—5 in FIG. 2.
Figure 6:
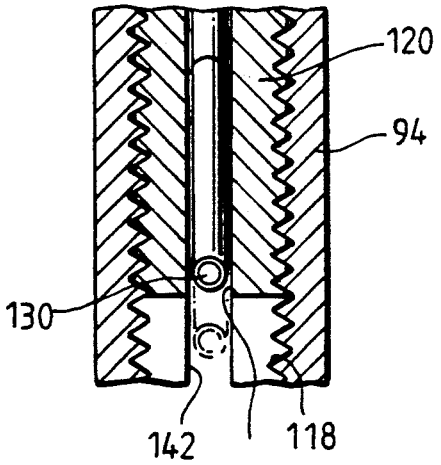
FIG. 6 is a cross-sectional view of the drive mechanism taken along line 6—6 in FIG. 5.

As shown with further reference to FIGS. 5 and 6, the screw 120 has an inner bore 126, and a bar 128 having a T-shaped lower end 130. Further, a polygonally-shaped upper end 132 extends completely through the bore 126. Preferably, a plate 134 is affixed to the upper end of the bar 128 to form the polygonally-shaped upper end 132, the purpose of which is described subsequently herein.

A spring 136 is disposed around the bar 128 between the plate 134 and a bearing washer 138, and biases the plate 134, and thus the bar 128, upwardly. The T-shaped lower end 130 of the bar 128 extends radially outwardly from the shaft 94 through a pair of axial slots 142, 144 in the sides of the tubular shaft 94.

The bar 128 is axially moveable between a rotation-preventing position and a rotation-allowing position. In its upwardly biased position, i.e., the rotation allowing position, the T-shaped end 130 of the bar 128 rests within a transversely extending notch 140 in the lower end of the screw 120. Since the bar 128 cannot rotate by virtue of its T-shaped lower end 130 extending through the slots 142, 144, the screw 120 cannot rotate without rotating the shaft 94 as well.

Therefore, rotation of the screw 120 does not move the shaft 94 axially, because the screw 120 and the shaft 94 cannot move relative to one another. Conversely, if the bar 128 is moved downwardly against the force of the spring 136, the T-shaped lower end 130 of the bar does not rest within the notch 140, as illustrated by the phantom lines in FIGS. 2, 5 and 6. If the bar 128 is prevented from rotating, the shaft 94 cannot rotate since the T-shaped lower end 130 of the bar 128 extends through the slots 142, 144. Therefore, rotation of the screw 120 causes the shaft 94 to move linearly in either vertical direction so that the gears can be positioned properly.

To prevent the bar 128 from rotating during the gear positioning operation, the control 85 moves the paper feeding mechanism 87 upwardly to a gear positioning location. In the gear positioning location, a bumper 146 on the paper feeding mechanism 87 pushes a first end 150 of a lever 148 upwardly, as shown by the phantom lines in FIG. 2. This causes a second end 152 of the lever 148 to push downwardly onto the polygonally-shaped plate 134 of the bar 128, thus compressing the spring 136 and moving the T-shaped lower end 130 of the bar 128 out of the notch 140.

Figure 3:
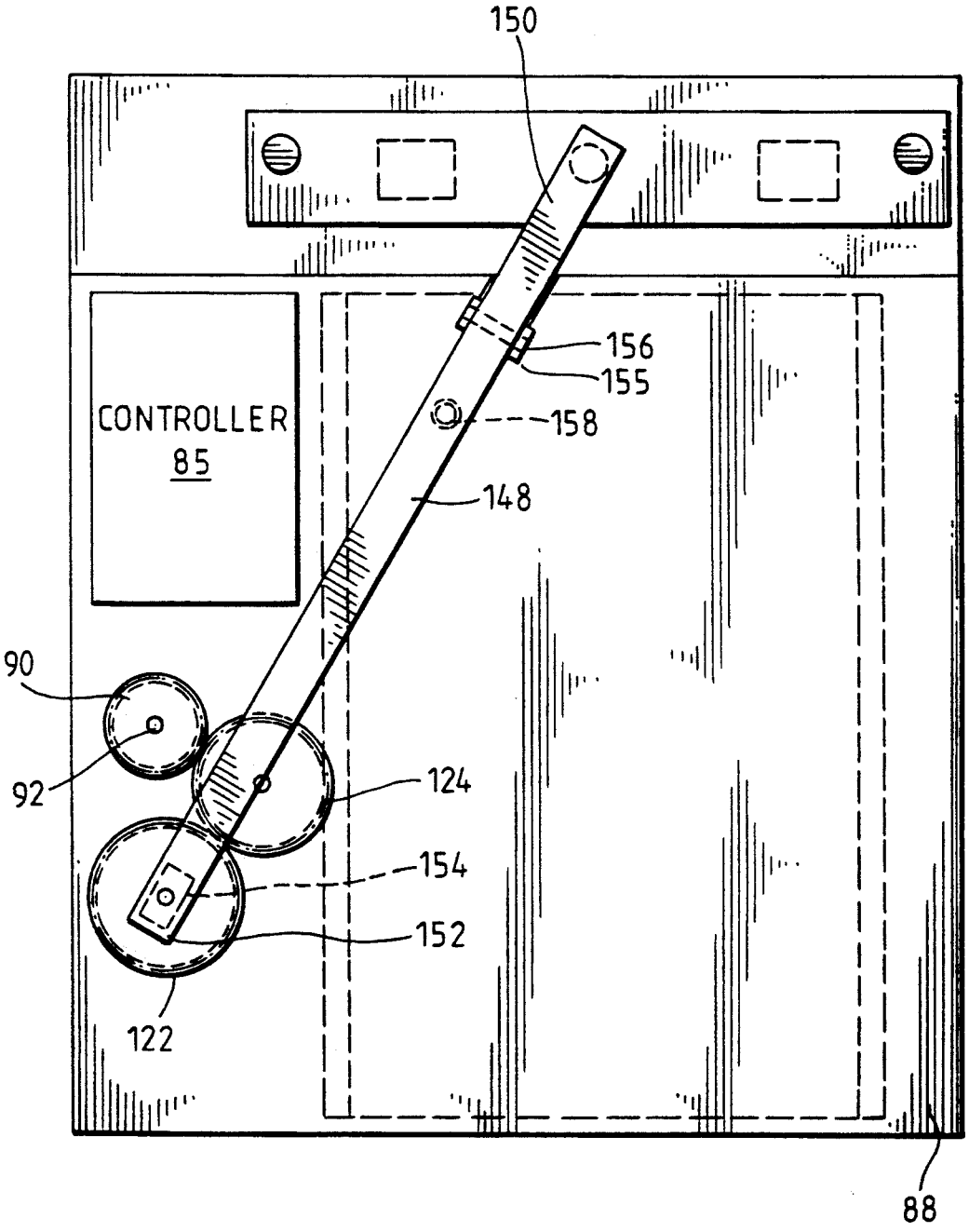
FIG. 3 is a detailed top plan view of FIG. 2.

The second end 152 of the lever 148 includes a polygonally-shaped recess 154, which is similar in shape to the polygonally-shaped plate 134 and which accepts the polygonally-shaped plate 134. Since the plate 134 resides within the recess 154, the bar 128 cannot rotate. For ease of construction, the lever 148 is shown in FIG. 3 to extend through an aperture 155 in the upper portion 88 of the frame 84 and to be pivotally connected thereto by a bar 156.

It is important to note that, during the gear positioning operation, the trays 52, 54, 56 are in the first unselected position, as shown in FIG. 2. Once the selected gear has been properly engaged with its associated rack, the control 85 moves the paper feeding mechanism downwardly to a tray positioning location.

In the tray positioning location, the paper feeding mechanism 87 remains higher than the tray 52, but the bumper 146 no longer engages the first end 150 of the lever 148. Therefore, a spring 158, mounted between the lever 148 and the upper portion 88 of the frame 84, biases the second end 152 of the lever 148 upwardly so that it no longer engages the plate 134. Since the bar 128 is free to rotate in response to rotation of the screw 120, rotation of the screw 120 in a first direction causes the shaft 94 to rotate and slide one of the trays into its second preselected paper-feeding position.

If at any time during the printing operation the control 85 receives a request to withdraw paper from a different tray, the shaft 94 is rotated in a second direction, causing the tray to return to its first unselected rest position. The control 85 then moves the paper feeding mechanism 87 into its gear positioning location so that the gears may be repositioned into contact with the rack of the newly selected tray. The control 85 delivers a signal to the motor 86 that cause the motor 86 to rotate by a predetermined amount, and, thus, move the shaft 94 in the appropriate vertical direction to bring the proper gear into engagement with the proper rack.

The control 85 then moves the paper feeding mechanism 87 into its tray positioning location so that the selected tray may be slid into its second paper-feeding position. This is accomplished by again rotating the motor 86 by a predetermined amount in the appropriate direction. Once the newly selected tray is in position, the paper feeding mechanism 87 lowers until the rotatable wheel 89 contacts the paper in the selected tray.

Preferably, the motor 86 is a stepper motor and the number of teeth per inch on the screw 120 are selected so that the shaft 94 is controllably moved in either vertical direction. The control 85 contains a memory that stores a correspondence curve relating the number of turns of the motor 86 to the corresponding vertical distance traveled by the shaft 94 in response to the number of turns of the motor 86. With this information, the control 85 applies a predetermined voltage signal via line 99 to the motor 86 that causes the motor 86 to turn a selected number of "steps," which corresponds to a selected amount of rotation.

The control 85 also stores the present position of each of the gears 100, 102, 104, and the position of each of the racks 112, 114, 116. Therefore, when the control 85 receives a request to withdraw paper from a selected tray 52, 54, 56, the control 85 determines the distance between the proper gear and its associated rack and the direction of shaft movement needed to bring the gear into engagement with the rack. An appropriate voltage is applied to the stepper motor, rotating the stepper motor by a selected amount that corresponds to the vertical distance between the gear and the rack, and in a selected direction that brings the gear into engagement with the rack.

It should be appreciated that when the printer is between print requests, all of the trays 52, 54, 56 are readily available for receiving paper. The added paper can either be additional paper of the same type, or small quantities of special paper specifically loaded for a special print request (i.e. transparencies for overheads, special size paper, special color paper, etc.). Loading the trays 52, 54, 56 is particularly simple because, unlike the prior devices, the paper feeding mechanism 20 is not in contact with the stack of paper. Thus, owing to a lack of mechanical obstructions, the paper is directly loadable into the trays 52, 54, 56 from the rear of the apparatus.

Moreover, referring again to FIG. 1, the motor 28 also drives the trays 12, 14, 16, 18 in the reverse direction to enhance user accessibility. A series of slides 130, 132, 134, 136, similar to furniture drawer slides, respectively support the trays 12, 14, 16, 18 and permit the trays to be fully extended to the right in FIG. 1.

Further, each of the trays 12, 14, 16, 18 are also manually movable to the right when the transmission 48 is not engaging the motor 28 with the respective racks 40, 42, 44, 46. The user is free to grasp each of the trays 12, 14, 16, 18 and slide them to the right, thereby exposing the top of the tray for easy loading of the desired paper.

An additional feature of the apparatus 10 involves the trays 12, 14, 16, 18 being user configurable. For example, in some instances it is desireable that rather than have four independently accessible trays 12, 14, 16, 18 that are each capable of holding, for example, five-hundred sheets of paper, that only a single tray be available that has a capacity of, for example, two-thousand sheets of paper.

The user readily adapts the apparatus 10 for such use by physically removing the upper trays 14, 16, 18 and then reprogramming the controller to indicate that only the single lower tray is available for use. Since the upper trays 14, 16, 18 are removed, paper is stacked into the lower tray 12 to a maximum height that permits the tray 12 and paper to move horizontally under the sheet feeding mechanism 20.

We claim:

1. A paper handling apparatus comprising:

paper feeding means for contacting a selected one of a plurality of stacks of sheets of paper and removing a selected one of said sheets of paper from said selected stack of sheets of paper, said paper feeding means being controllably moveable along a preselected substantially vertical path;

a plurality of paper receiving trays, each of said trays being adapted for receiving a stack of sheets of paper, said plurality of trays being generally vertically arranged relative to one another and adapted for general horizontal movement between a first extended position and a second retracted position, wherein said first extended position intersects the substantially vertical path of said paper feeding means;

a motor;

paper tray drive means for moving a selected tray between said first extended position and said second retracted position; and, a transmission which couples the motor to the paper tray drive means, said transmission having a first condition wherein rotation of the motor positions the paper tray drive means to engage a selected tray and a second condition wherein rotation of the motor effects horizontal movement of the selected tray between the second retracted position and the first extended position.

2. A paper handling apparatus as recited in claim 1 wherein the transmission is operatively connected to the paper feeding means such that movement of the paper feeding means along a selected portion of its substantially vertical path effects a change in the transmission from said first condition to said second condition.

3. The apparatus of claim 2 wherein the selected portion of the substantially vertical path of the paper feeding means is one extreme of said path of the paper feeding means.

4. A paper handling apparatus comprising:

paper feeding means for contacting a selected one of a plurality of stacks of sheets of paper and removing a selected one of said sheets of paper from said selected stack of sheets of paper, said paper feeding means being controllably moveable along a preselected substantially vertical path;

a plurality of paper receiving trays, each of said trays being adapted for receiving a stack of sheets of paper, said plurality of trays being generally vertically arranged relative to one another and adapted for general horizontal movement between a first extended position and a second retracted position, wherein said first extended position intersects the substantially vertical path of said paper feeding means;

a motor;

paper tray drive means for moving a selected tray between said first extended position and said second retracted position;

a transmission which couples the motor to the paper tray drive means, said transmission having a first condition wherein rotation of the motor positions the paper tray drive means to engage a selected tray and a second condition wherein rotation of the motor effects horizontal movement of the selected tray between the second retracted position and the first extended position, said transmission being operatively connected to the paper feeding means such that movement of the paper feeding means at one extreme of its substantially vertical path effects a change in the transmission from said first condition to said second condition; and, a lever having a first end and a second end, the first end of which is contacted and moved by the paper feeding means at one extreme of its path and the second end of which operates the transmission such that movement of the lever effects a change in the transmission from said first condition to said second condition.

* * * * *